United States Patent [19]

Warnod

[11] 4,057,799

[45] Nov. 8, 1977

[54] ELECTRO-ACOUSTIC SIGNALLING HORNS

[75] Inventor: Bertrand Antoine Warnod, Neuilly, France

[73] Assignee: Klaxon S.A., Courbevoie, France

[21] Appl. No.: 746,754

[22] Filed: Dec. 2, 1976

[30] Foreign Application Priority Data

Dec. 19, 1975 France ..... 75.38952

[51] Int. Cl.[2] ..... G08B 3/10

[52] U.S. Cl. ..... 340/388; 340/404

[58] Field of Search ..... 340/388, 404, 389, 390, 340/391

[56] References Cited

U.S. PATENT DOCUMENTS

| | | | |
|---|---|---|---|
| 2,193,544 | 3/1940 | Wiley | 340/388 |
| 2,640,981 | 6/1953 | Moulding | 340/388 |
| 3,041,601 | 6/1962 | Wetzel | 340/388 |

*Primary Examiner*—Harold I. Pitts

*Attorney, Agent, or Firm*—Nolte and Nolte

[57] ABSTRACT

An electro-acoustic signalling horn of the type comprising a case containing an electromagnetic excitation system, a diaphragm subjected to the action of said system, and a sound amplifying box extending a labyrinth chamber. Said box is in a single moulded piece and has a lateral opening opening into said chamber and adapted to receive the diaphragm and the case. Said diaphragm and said case are rendered integral by a metal plate having an edge portion formed over onto a peripheral portion of the diaphragm and the case, the assembly comprising the case, the diaphragm and the plate being maintained in said opening by adhesion of the plate to the adjacent portion of the labyrinth chamber and cooperation of the formed-over peripheral portion of the plate with the edge of the opening.

7 Claims, 2 Drawing Figures

ELECTRO-ACOUSTIC SIGNALLING HORNS

BACKGROUND OF THE INVENTION

The present invention relates to improvements in the electro-acoustic signalling horns employed in the automobile industry as sound warning devices.

These horns are constituted by a case containing an electromagnetic system which imparts a vibratory oscillation to a diaphragm, and a sound box having a labyrinth chamber facing the diaphragm. The diaphragm is clamped between the case and the box, the latter part usually being made from a plastics material.

It has been proposed to construct the box in two parts and to assemble one of these parts with the diaphragm and the case through the agency of a clipping band and then to weld or adhere the second part to the first part. The clipping thus obtained is not very precise and very sensitive to conditions of temperature, hygrometry, etc., since the clipping band bears against a part of plastics material which is itself very sensitive to these conditions. Moreover, there are a large number of parts to assemble and a large number of operations and this increases the price and decreases the output.

It has also been proposed to add to the diaphragm a metal plate which is itself secured to the case so as to obtain a metallic assembly which is of high precision but little sensitive to variations in temperature. The plate may be fixed to the sound box by moulding it on the latter, the diaphragm and the case being screwed or riveted to the plate. The box must also be constructed in two parts, which are thereafter welded or adhered together, so that the manufacture of the horn still requires a large number of operations. An object of the present invention is to avoid these drawbacks of known horns by means of a new cheaper horn which is constituted by a small number of component parts and is more easily and more rapidly assembled than the known horns.

SUMMARY OF THE INVENTION

According to the invention, there is provided an electro-acoustic signalling horn of the type comprising a case containing an electromagnetic exciting system, a diaphragm subjected to the action of said system, and an amplifying sound box extending a labyrinth chamber, wherein said box is in a single moulded piece and comprises a lateral opening opening into said chamber and adapted to receive the diaphragm and the case, said diaphragm and said case being rendered integral by a metal plate whose edge portion is folded over the peripheral portion of the diaphragm and the case, the assembly comprising the case, the diaphragm and the plate being maintained in said opening by adhesion of the plate to the adjacent portion of the labyrinth chamber and cooperation of the folded peripheral portion of the plate with the edge of the opening.

In the horn according to the invention, the sound box is in a single piece and this avoids a welding of the two half-shells constituting the box, as is the case with most of the known horns. The box is closed by the assembly comprising the case, the diaphragm and the plate, this assembly being produced beforehand and being easily mounted on the box. The adhesion of the plate to the box, required to preclude any escape of air in the labyrinth chamber, is usually sufficient to ensure the fixing of the box to the rest of the horn. The cooperation between the folded edge portion of the plate and the edge of the opening of the box has no need to be extremely strong, since it is of utility only during the drying or setting of the adhesive.

In one embodiment, the edge of the opening of the box has a continuous or discontinuous inwardly extending radial projection and the assembly is forced in said opening after an elastic deformation of said projection.

In a modification, at least a part of the edge of the opening of the box is upset or swaged over onto the formed-over edge portion of said plate.

DESCRIPTION OF THE DRAWINGS

The invention will be understood from the ensuing description with reference to the accompanying drawing in which.

DESCRIPTION OF THE PREFERRED EMBODIMENT

Figure 1:
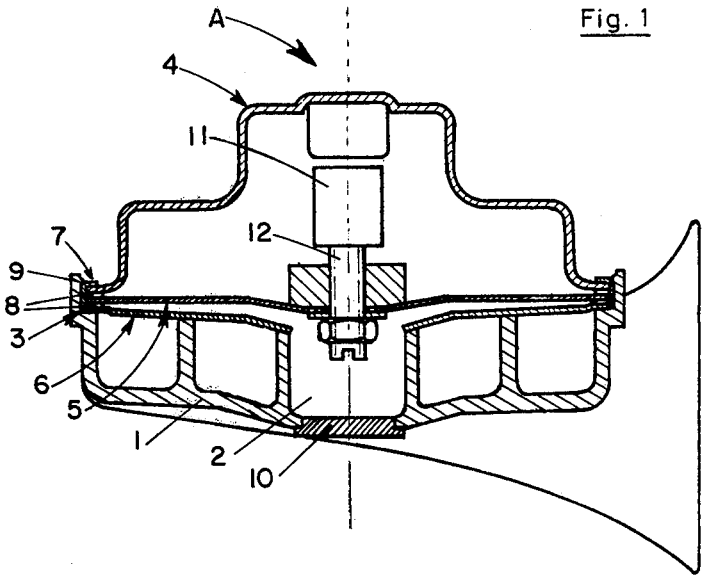
FIG. 1 is a sectional view of a horn according to one embodiment of the invention.
Figure 2:
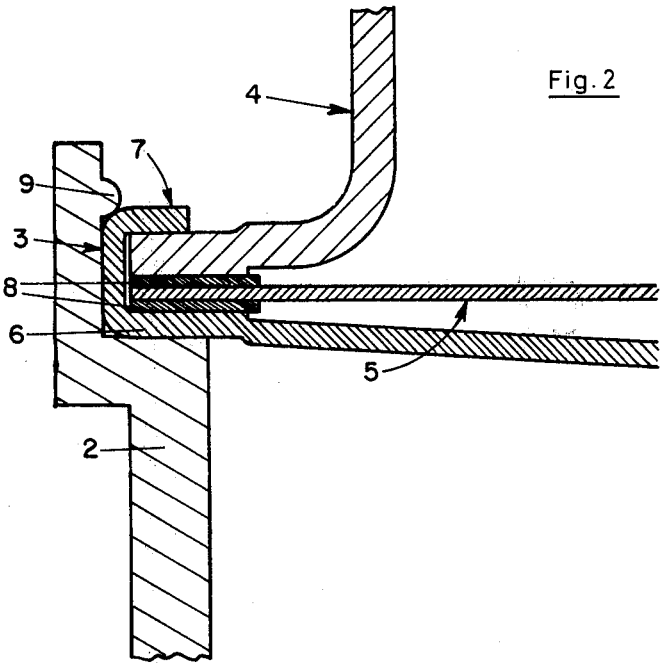
FIG. 2 is an enlarged view of a detail of a part of the horn shown in FIG. 1.

The horn according to the invention comprises a sound box 1 in one piece with a labyrinth chamber 2 comprising a lateral opening 3. The horn further comprises an assembly A constituted by a case 4 provided with an electromagnetic excitation system, a diaphragm 5 and a plate 6 whose edge portion 7 is formed over and bears on the edge portion of the case 4 and clamps the edge portion of the diaphragm 5. Sealing elements 8 may be interposed between the diaphragm and the plate and between the diaphragm and the case.

The assembly A is assembled and formed over beforehand and then placed in the opening 3, the plate 6 being adhered to the adjacent edge portion of the labyrinth profile of the chamber 2. In the described embodiment, the free edge 9 of the opening 3 is then upset or swaged onto the edge portion of the case 4 so as to render the assembly A and the box 1 integral with each other, at least during the setting of the adhesive. Any other fixing system may be envisaged. For example, the opening 3 may have a continuous or discontinuous inwardly extending radial projection, the assembly A then being forced into the opening 3 by elastically deforming the projection which places itself in the position of the edge 9.

Subsequent to assembly, the interior of the horn is not accessible and this prevents any regulation of the air-gap of the electromagnetic system. In order to overcome this drawback, the invention provides an access passage 10 in the bottom of the box 1. This access passage permits the regulation of the position of the moving core 11 which may be integral, in the known manner with a regulating screw 12. The access passage 10 may be closed by a detachable plug or by way of a modification, defined by a weakened zone of the plastics material of the box. In the latter case, if a regulation is required, it is sufficient to tear away the closure means defined by the weakened zone, effect the regulation, and then plug the access passage 10 thus formed with a plug.

What is claimed is:

1. An electro-acoustic signalling horn comprising a case containing an electromagnetic excitation system and having an open front face, a diaphragm subjected to the action of said system and extending across said front face, a closure plate disposed at the front of said casing and having an edge portion folded over a corresponding peripheral edge portion of said case and said diaphragm to unite said case and diaphragm into an assembly, a sound box comprising a unitary element having a base wall and scroll-like wall means upstanding therefrom, a continuous edge of said wall means remote from said base wall secured to said closure plate by an adhesive, said base wall, wall means and closure plate together defining a labyrinthine passage, said sound box having a peripheral edge configuration cooperating with said edge portion of said plate.

2. A horn as claimed in claim 1, wherein the configuration of the box comprises a inwardly extending radial projection and the assembly is forced into said opening after an elastic deformation of said projection.

3. A horn as claimed in claim 1, wherein at least a part of the edge of the opening of the box is upset or swaged onto the formed-over edge portion of said plate.

4. A horn as claimed in claim 1, wherein the base wall of the box has an opening closed by a removable plug said opening allowing access to a device for regulating the air-gap of the electromagnetic system.

5. A horn as claimed in claim 2, wherein the base wall of the box has an opening closed by a removable plug, said opening allowing access to a device for regulating the air gap of the electro-magnetic system.

6. A horn as claimed in claim 3, wherein the base wall of the box has an opening closed by a removable plug, said opening allowing access to a device for regulating the air-gap of the electro-magnetic system.

7. A horn as claimed in claim 2, wherein said projection extends continuously about said box.

* * * * *